US012398728B2

(12) United States Patent
Hirano et al.

(10) Patent No.: US 12,398,728 B2
(45) Date of Patent: Aug. 26, 2025

(54) CENTRIFUGAL COMPRESSOR

(71) Applicant: KABUSHIKI KAISHA TOYOTA JIDOSHOKKI, Kariya (JP)

(72) Inventors: Takayuki Hirano, Kariya (JP); Junya Suzuki, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/953,739

(22) Filed: Nov. 20, 2024

(65) Prior Publication Data

US 2025/0180035 A1 Jun. 5, 2025

(30) Foreign Application Priority Data

Nov. 30, 2023 (JP) ..... 2023-203146

(51) Int. Cl.

| | |
|---|---|
| ***F04D 29/42*** | (2006.01) |
| ***F04D 17/10*** | (2006.01) |
| ***F04D 25/06*** | (2006.01) |
| ***F04D 29/58*** | (2006.01) |

(52) U.S. Cl.

CPC ..... *F04D 29/4206* (2013.01); *F04D 17/10* (2013.01); *F04D 25/06* (2013.01); *F04D 29/582* (2013.01)

(58) Field of Classification Search

CPC ..... F04D 29/4206; F04D 17/10; F04D 25/06; F04D 29/582

See application file for complete search history.

(56) References Cited

U.S. PATENT DOCUMENTS

| | | | | |
|---|---|---|---|---|
| 11,274,679 | B2 * | 3/2022 | Sun | F04D 29/4206 |
| 2015/0167689 | A1 * | 6/2015 | Oda | F04D 1/04 415/110 |
| 2015/0233384 | A1 | 8/2015 | Thompson et al. | |
| 2015/0275920 | A1 | 10/2015 | Thompson et al. | |
| 2015/0308456 | A1 | 10/2015 | Thompson et al. | |
| 2017/0227012 | A1 * | 8/2017 | Hirata | F04D 29/52 |

FOREIGN PATENT DOCUMENTS

JP 2015-209845 A 11/2015

* cited by examiner

*Primary Examiner* — Hoang M Nguyen
(74) *Attorney, Agent, or Firm* — Sughrue Mion, PLLC

(57) ABSTRACT

A connection passage is formed by a first impeller housing member, a motor housing member, and a second impeller housing member. This prevents, for example, the formation of a gap between a housing and a pipe, which is separate from the housing, in a centrifugal compressor like in a configuration in which a first discharge port and a second suction port are connected to each other by attaching the pipe to the housing. The connection passage is formed only by sequentially overlapping and coupling the first impeller housing member, the motor housing member, and the second impeller housing member with each other in an axial direction of the rotary shaft. This eliminates, for example, the need to provide a structure in the pipe that absorbs the dimensional tolerances that occur between the housing and the pipe when attaching the pipe to the housing.

5 Claims, 3 Drawing Sheets

CENTRIFUGAL COMPRESSOR

BACKGROUND

1. Field

The present disclosure relates to a centrifugal compressor.

2. Description of Related Art

The centrifugal compressor includes a rotary shaft, a motor, and a housing. The motor rotates the rotary shaft. Additionally, the centrifugal compressor may include a first impeller and a second impeller. The first impeller rotates integrally with the rotary shaft to compress a fluid. The second impeller may be located on the opposite side of the first impeller, with the motor located between the second impeller and the rotary shaft.

The housing includes a first impeller chamber, a second impeller chamber, a first suction port, a first discharge port, a second suction port, and a second discharge port. The first impeller chamber accommodates the first impeller. The second impeller chamber accommodates the second impeller. The first suction port draws a fluid into the first impeller chamber. The first discharge port discharges the fluid compressed by the rotation of the first impeller. The second suction port draws a fluid into the second impeller chamber. The centrifugal compressor includes a connection passage. The second discharge port discharges the fluid compressed by the rotation of the second impeller. The connection passage connects the first discharge port to the second suction port such that a fluid flows from the first discharge port toward the second suction port. The connection passage is formed by a pipe that is separate from the housing as described in, for example, Japanese Laid-Open Patent Publication No. 2015-209845. The pipe is attached to the housing to connect the first discharge port to the second suction port through the connection passage.

Japanese Laid-Open Patent Publication No. 2015-209845 discloses a configuration in which the pipe, which is separate from the housing, is attached to the housing to connect the first discharge port to the second suction port through the connection passage. In this configuration, the centrifugal compressor includes a gap between the housing and the pipe. The gap between the housing and the pipe is a dead space in the centrifugal compressor. Thus, the centrifugal compressor is unnecessarily enlarged by an amount corresponding to the gap between the housing and the pipe.

Moreover, dimensional tolerances occur between the housing and the pipe. This necessitates, for example, providing a structure in the pipe that can absorb the dimensional tolerances that occur between the housing and the pipe when attaching the pipe to the housing, resulting in a factor that reduces the production efficiency of the centrifugal compressor. Accordingly, it is desirable to improve the production efficiency of the centrifugal compressor while also limiting its increase in size.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure provides a centrifugal compressor. The centrifugal compressor includes a rotary shaft, a motor that rotates the rotary shaft, a first impeller that rotates integrally with the rotary shaft to compress a fluid, and a second impeller located on an opposite side of the rotary shaft from the first impeller. The motor is arranged between the first impeller and the second impeller. The second impeller rotates integrally with the rotary shaft. The centrifugal compressor also includes a housing. The housing includes a first impeller housing member, a motor housing member, a second impeller housing member. The first impeller housing member defines a first impeller chamber accommodating the first impeller. The first impeller housing member includes a first suction port that draws the fluid into the first impeller chamber and a first discharge port that discharges the fluid compressed by rotation of the first impeller. The motor housing member defines a motor chamber accommodating the motor. The second impeller housing member defines a second impeller chamber accommodating the second impeller. The second impeller housing member includes a second suction port that draws the fluid into the second impeller chamber and a second discharge port that discharges the fluid compressed by rotation of the second impeller. The centrifugal compressor further includes a connection passage that connects the first discharge port to the second suction port such that the fluid flows from the first discharge port toward the second suction port. The connection passage includes a first impeller housing member connection passage located in the first impeller housing member and connected to the first discharge port, a second impeller housing member connection passage located in the second impeller housing member and connected to the second suction port, and a motor housing member connection passage extending through the motor housing member and connecting the first impeller housing member connection passage to the second impeller housing member connection passage. The connection passage is formed by sequentially overlapping the first impeller housing member, the motor housing member, and the second impeller housing member with each other in an axial direction of the rotary shaft.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

A centrifugal compressor according to an embodiment will now be described with reference to FIGS. 1 to 5. The centrifugal compressor of the present embodiment is mounted on a fuel cell electric vehicle. The centrifugal compressor compresses air as fluid.

Basic Structure of Centrifugal Compressor

Figure 1:
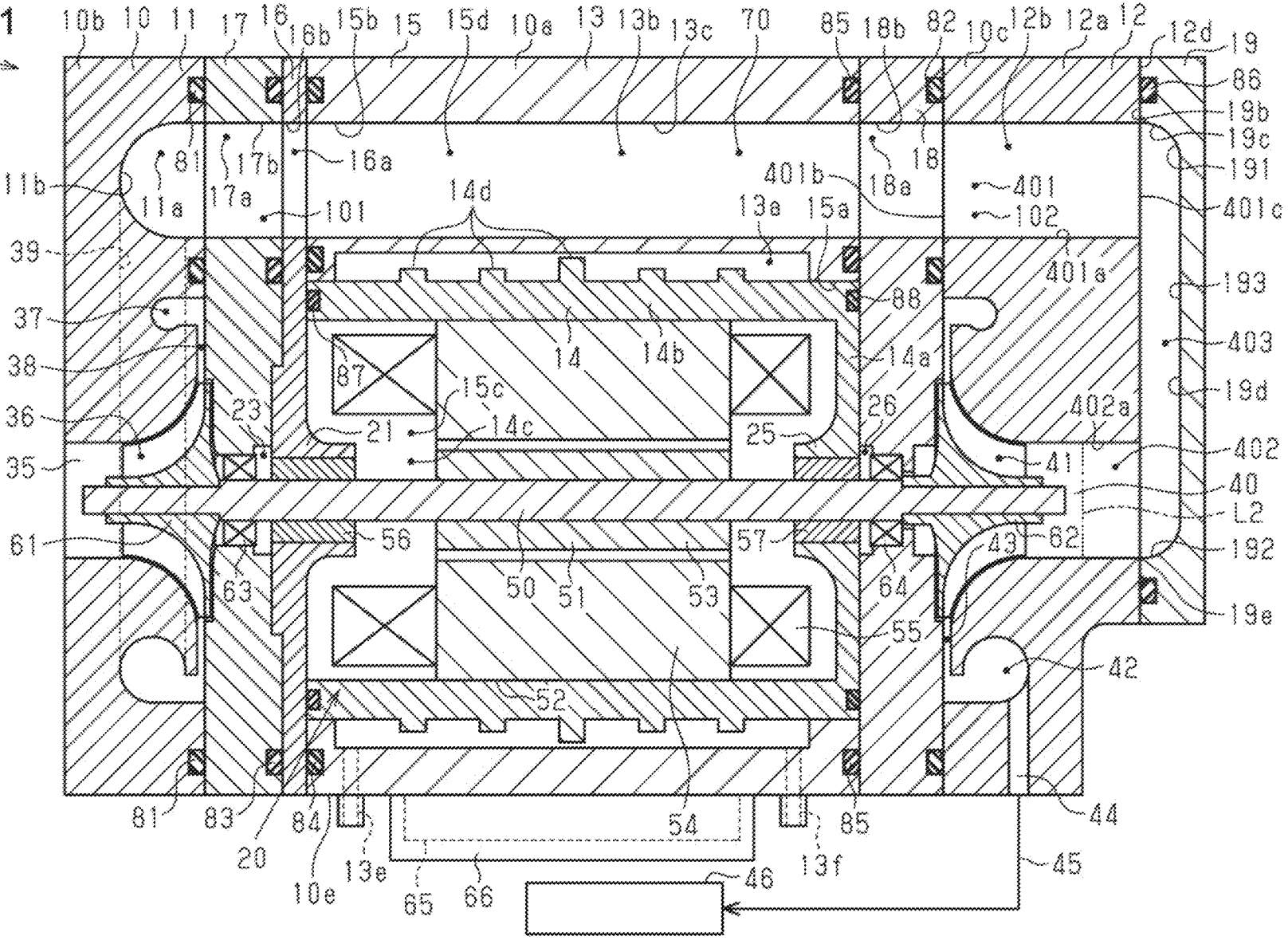
FIG. 1 is a cross-sectional view of a centrifugal compressor.

As shown in FIG. 1, a centrifugal compressor 100 includes a housing 10. The housing 10 is made of metal. The housing 10 is made of, for example, aluminum. The housing 10 includes a motor housing member 10*a*, a first impeller housing member 10*b*, and a second impeller housing member 10*c*. The motor housing member 10*a* includes a first motor housing member 14 and a connection passage defining housing member 13. The first impeller housing member 10*b* includes a first compressor housing member 11 and a second plate 17. The second impeller housing member 10*c* includes a second compressor housing member 12 and a third plate 18. The second compressor housing member 12 includes a second impeller housing member base 12*a* and a second impeller housing member cover 19. In other words, the second impeller housing member 10*c* includes the second impeller housing member base 12*a* and the second impeller housing member cover 19.

The first motor housing member 14 includes an end wall 14*a* and a circumferential wall 14*b*. The first motor housing member 14 has a cylindrical shape. The end wall 14*a* has a plate shape. The circumferential wall 14*b* extends in a tubular shape from an outer circumferential portion of the end wall 14*a*. The first motor housing member 14 is manufactured through die casting.

The connection passage defining housing member 13 includes a second motor housing member 15 and a first plate 16. In other words, the motor housing member 10*a* includes the first motor housing member 14 and the second motor housing member 15. The second motor housing member 15 and the first plate 16 are manufactured through die casting.

The second motor housing member 15 has a tubular shape. The second motor housing member 15 includes a motor housing member accommodation hole 15*c*. The second motor housing member 15 includes an accommodation hole defining surface 15*a*. The accommodation hole defining surface 15*a* defines the motor housing member accommodation hole 15*c*. The motor housing member accommodation hole 15*c* extends in the axial direction of the second motor housing member 15 and opens in the opposite end faces of the second motor housing member 15 in the axial direction. The motor housing member accommodation hole 15*c* accommodates the first motor housing member 14 such that the outer circumferential surface of the circumferential wall 14*b* of the first motor housing member 14 faces the accommodation hole defining surface 15*a* in the radial direction of the second motor housing member 15. The axis of the second motor housing member 15 coincides with the axis of the circumferential wall 14*b* of the first motor housing member 14.

The centrifugal compressor 100 includes a cooling medium passage 13*a*. The cooling medium passage 13*a* is defined by the outer circumferential surface of the circumferential wall 14*b* of the first motor housing member 14 and the accommodation hole defining surface 15*a*. The cooling medium passage 13*a* is defined such that coolant flows between the first motor housing member 14 and the second motor housing member 15. In other words, the cooling medium passage 13*a* is defined by the first motor housing member 14 and the second motor housing member 15. The cooling medium passage 13*a* extends along the circumferential wall 14*b* of the first motor housing member 14 and has an annular shape surrounding the circumferential wall 14*b*. The second motor housing member 15 has a supply port 13*e* and a discharge port 13*f*. The supply port 13*e* supplies coolant to the cooling medium passage 13*a*. The discharge port 13*f* discharges, to the outside of the housing 10, the coolant that has flowed through the cooling medium passage 13*a*. The coolant flowing through the cooling medium passage 13*a* cools the first motor housing member 14 and the second motor housing member 15.

Fins 14*d* are provided on the outer circumferential surface of the circumferential wall 14*b* of the first motor housing member 14. The fins 14*d* protrude from the outer circumferential surface of the circumferential wall 14*b* of the first motor housing member 14 into the cooling medium passage 13*a*. The fins 14*d* are annular thin plates that extend along the outer circumferential surface of the circumferential wall 14*b*. The fins 14*d* are arranged at intervals in the axial direction of the first motor housing member 14 on the outer circumferential surface of the circumferential wall 14*b* of the first motor housing member 14. The fins 14*d* are formed integrally with the first motor housing member 14. Coolant flows through the cooling medium passage 13*a*, along each fin 14*d*, in the circumferential direction of the first motor housing member 14 and the second motor housing member 15.

The first plate 16 is coupled to the end of the circumferential wall 14*b* of the first motor housing member 14 on a side opposite to the end wall 14*a* and to a first end of the second motor housing member 15. The first plate 16 is coupled to the circumferential wall 14*b* of the first motor housing member 14 and the second motor housing member 15, with the thickness direction of the first plate 16 coinciding with the axial direction of the circumferential wall 14*b* of the first motor housing member 14 and the axial direction of the second motor housing member 15. The first plate 16 closes the opening of the circumferential wall 14*b* of the first motor housing member 14. Additionally, the first motor housing member 14 and the first plate 16 define a motor chamber 14*c*. Thus, the motor housing member 10*a* defines the motor chamber 14*c*.

The first plate 16 includes a first bearing retainer 21. The first bearing retainer 21 is cylindrical. The first bearing retainer 21 protrudes into the motor chamber 14*c*. The axis of the first bearing retainer 21 coincides with the axis of the circumferential wall 14*b* of the first motor housing member 14.

The end wall 14*a* of the first motor housing member 14 includes a second bearing retainer 25. The second bearing retainer 25 is cylindrical. The second bearing retainer 25 protrudes into the motor chamber 14*c*. The axis of the second bearing retainer 25 coincides with the axis of the first bearing retainer 21.

The second plate 17 is manufactured through die casting. The second plate 17 is coupled to the end face of the first plate 16 on a side opposite to the first motor housing member 14 and the second motor housing member 15. The second plate 17 is coupled to the first plate 16, with the thickness direction of the second plate 17 coinciding with the thickness direction of the first plate 16. The second plate 17 has a first insertion hole 23. The axis of the first insertion hole 23 coincides with the axis of the first bearing retainer 21. The first insertion hole 23 is connected to the interior of the first bearing retainer 21.

The third plate 18 is manufactured through die casting. The third plate 18 is coupled to the outer surface of the end wall 14*a* of the first motor housing member 14 and to a second end of the second motor housing member 15. The third plate 18 is coupled to the end wall 14*a* of the first motor housing member 14 and the second motor housing member 15, with the thickness direction of the third plate 18 coinciding with the thickness direction of the end wall 14*a* of the first motor housing member 14.

The third plate 18 has a second insertion hole 26. The second insertion hole 26 extends through the third plate 18 in the thickness direction of the third plate 18. The second insertion hole 26 is connected to the interior of the second bearing retainer 25. The axis of the second insertion hole 26 coincides with the axis of the second bearing retainer 25.

The centrifugal compressor 100 includes a motor 20. The motor 20 is accommodated in the motor chamber 14*c*. Thus, the motor chamber 14*c* accommodates the motor 20. The first motor housing member 14 surrounds the motor 20. The heat generated from the motor 20 is dissipated to the first motor housing member 14. The first motor housing member 14 is cooled by the coolant flowing through the cooling medium passage 13*a*. Thus, the heat generated by the motor 20 is efficiently dissipated to the first motor housing member 14. As a result, the motor 20 is cooled. That is, the motor housing member 10*a* includes the cooling medium passage 13*a*, through which coolant as cooling medium flows to cool the motor 20.

The first compressor housing member 11 is manufactured through die-casting. The first compressor housing member 11 has a circular first suction port 35 through which air is drawn in. Thus, the first impeller housing member 10*b* includes the first suction port 35. The first compressor housing member 11 is coupled to the end face of the second plate 17 on a side opposite to the first plate 16, with the axis of the first suction port 35 coinciding with the axis of the first insertion hole 23. The first suction port 35 opens in the end face of the first compressor housing member 11 on a side opposite to the second plate 17. Air that has been cleaned by an air cleaner (not shown) flows through the first suction port 35.

The centrifugal compressor 100 includes a first impeller chamber 36, a first discharge chamber 37, and a first diffuser passage 38. The first impeller chamber 36, the first discharge chamber 37, and the first diffuser passage 38 are located between the first compressor housing member 11 and the second plate 17. Thus, the first impeller housing member 10*b* defines the first impeller chamber 36. The first impeller chamber 36 is connected to the first suction port 35. The first suction port 35 draws air into the first impeller chamber 36. The first discharge chamber 37 is located around the first impeller chamber 36 and extends about the axis of the first suction port 35. The first diffuser passage 38 connects between the first impeller chamber 36 and the first discharge chamber 37. The first impeller chamber 36 is connected to the first insertion hole 23.

Figure 2:
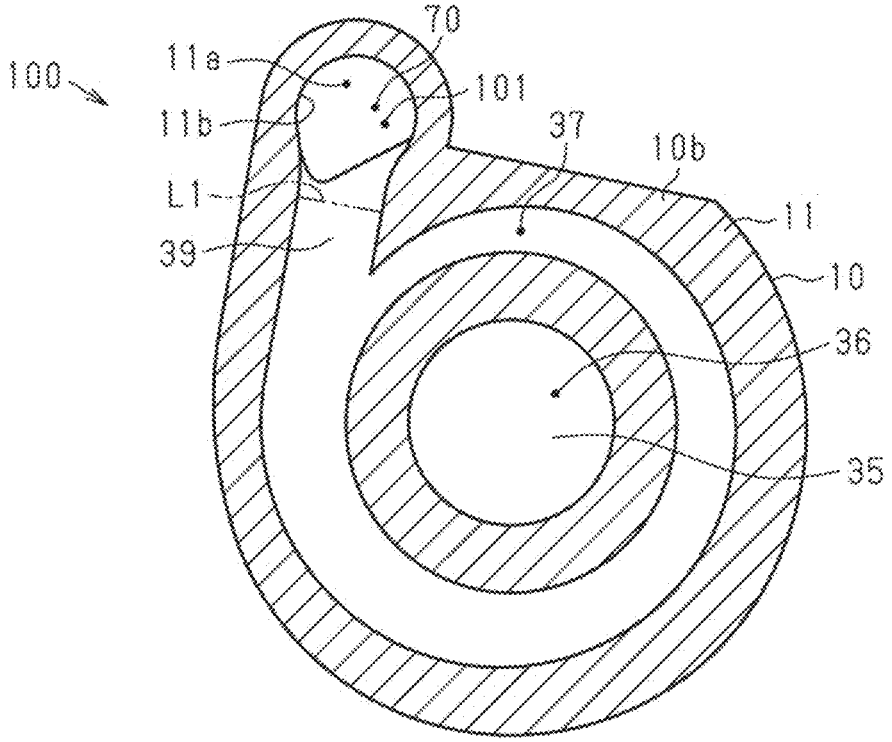
FIG. 2 is a cross-sectional view of the first impeller housing member.

As shown in FIG. 2, the first compressor housing member 11 includes a first discharge port 39. Thus, the first impeller housing member 10*b* includes the first discharge port 39. A first end of the first discharge port 39 is connected to the first discharge chamber 37.

Referring to FIG. 1, the second impeller housing member base 12*a* is manufactured through die casting. The second impeller housing member base 12*a* has a circular second suction port 40. The second suction port 40 opens in the second impeller housing member base 12*a*. Thus, the second impeller housing member 10*c* includes the second suction port 40. The second impeller housing member base 12*a* is coupled to the end face of the third plate 18 on a side opposite to the first motor housing member 14 and the second motor housing member 15, with the axis of the second suction port 40 coinciding with the axis of the second insertion hole 26.

The centrifugal compressor 100 includes a second impeller chamber 41, a second discharge chamber 42, and a second diffuser passage 43. The second impeller chamber 41, the second discharge chamber 42, and the second diffuser passage 43 are located between the second impeller housing member base 12*a* and the third plate 18. Thus, the second impeller housing member 10*c* defines the second impeller chamber 41. The second impeller chamber 41 is connected to the second suction port 40. The second suction port 40 draws air into the second impeller chamber 41. The second discharge chamber 42 is located around the second impeller chamber 41 and extends about the axis of the second suction port 40. The second diffuser passage 43 connects the second impeller chamber 41 between the second discharge chamber 42. The second impeller chamber 41 is connected to the second insertion hole 26.

The second impeller housing member base 12*a* has a second discharge port 44. The second discharge port 44 opens in the second impeller housing member base 12*a*. In other words, the second impeller housing member 10*c* has the second discharge port 44. A first end of the second discharge port 44 is connected to the second discharge chamber 42. A second end of the second discharge port 44 opens in the outer circumferential surface of the second impeller housing member base 12*a*.

A supply pipe 45 is connected to the second discharge port 44. The supply pipe 45 is connected to a fuel cell stack 46. A first end of the supply pipe 45 is connected to the second discharge port 44. A second end of the supply pipe 45 is connected to the fuel cell stack 46.

The centrifugal compressor 100 includes a rotary shaft 50. The rotary shaft 50, with its axis coinciding with the axis of the circumferential wall 14*b* of the first motor housing member 14, extends across the motor chamber 14*c*. A first end, which is one end in the axial direction, of the rotary shaft 50 protrudes into the first impeller chamber 36 from the inside of the motor chamber 14*c*, through the interior of the first bearing retainer 21 and the first insertion hole 23. A second end, which is the other end in the axial direction, of the rotary shaft 50 protrudes into the second impeller chamber 41 from the interior of the motor chamber 14*c*, through the interior of the second bearing retainer 25 and the second insertion hole 26.

The motor 20 includes a cylindrical stator 52 and a rotor 51. The rotor 51 is fixed to the rotary shaft 50. The rotor 51 includes a cylindrical rotor core 53 that is fixed to the rotary shaft 50 and permanent magnets (not shown) that are provided in the rotor core 53. The rotor 51 is installed on the rotary shaft 50 and rotates integrally with the rotary shaft 50.

The stator 52 is fixed to the first motor housing member 14. The stator 52 is disposed on the outer side of the rotor 51. The stator 52 includes a cylindrical stator core 54 and a coil 55. The stator core 54 is fixed to the inner circumferential surface of the circumferential wall 14*b* of the first motor housing member 14. In other words, the motor housing member 10*a* includes the first motor housing member 14 having an inner circumferential surface to which the stator 52 is fixed. The coil 55 is wound around the stator core 54. The rotary shaft 50 rotates integrally with the rotor 51 when current flows through the coils 55 from a battery (not shown). Therefore, the motor 20 rotates the rotary shaft 50.

The centrifugal compressor 100 includes a first dynamic plain bearing 56 and a second dynamic plain bearing 57. The first dynamic plain bearing 56 is cylindrical. The first dynamic plain bearing 56 is retained by the first bearing retainer 21. The first dynamic plain bearing 56 supports the rotary shaft 50 to be rotatable with respect to the first plate 16.

The second dynamic plain bearing 57 is cylindrical. The second dynamic plain bearing 57 is retained by the second bearing retainer 25. The second dynamic plain bearing 57 supports the rotary shaft 50 to be rotatable with respect to the end wall 14*a* of the first motor housing member 14. Thus, the first dynamic plain bearing 56 and the second dynamic plain bearing 57 support the rotary shaft 50 to be rotatable with respect to the housing 10.

The first dynamic plain bearing 56 and the second dynamic plain bearing 57 support the rotary shaft 50 to be rotatable in the radial direction with respect to the housing 10.

The centrifugal compressor 100 may include a known thrust bearing that supports the rotary shaft 50 to be rotatable in a thrust direction with respect to the housing 10.

The centrifugal compressor 100 includes a first impeller 61 and a second impeller 62. The first impeller 61 is coupled to the first end of the rotary shaft 50. The first impeller 61 is accommodated in the first impeller chamber 36. The first impeller chamber 36 thus accommodates the first impeller 61. The first impeller 61 rotates integrally with the rotary shaft 50 to compress air.

The second impeller 62 is coupled to the second end of the rotary shaft 50. In other words, the second impeller 62 is located on the opposite side of the first impeller 61, with the motor 20 located between the second impeller 62 and the rotary shaft 50. The second impeller 62 is accommodated in the second impeller chamber 41. The second impeller chamber 41 thus accommodates the second impeller 62. The second impeller 62 rotates integrally with the rotary shaft 50 to compress the air that has been compressed by the rotation of the first impeller 61. The first impeller 61 and the second impeller 62 rotate to compress air that is supplied to the fuel cell stack 46.

The first impeller 61 and the second impeller 62 rotate integrally with the rotary shaft 50 through the driving of the motor 20. Thus, the motor 20 rotates the first impeller 61 and the second impeller 62.

Inverter

The centrifugal compressor 100 includes an inverter 65. The inverter 65 is electrically connected to the motor 20. The inverter 65 controls the driving of the motor 20 by controlling power that is supplied to the coil 55.

The centrifugal compressor 100 includes an inverter housing member 66. The inverter housing member 66 accommodates the inverter 65. The inverter housing member 66 is provided on the outer surface of the second motor housing member 15. In other words, the inverter 65 is provided on a housing outer surface 10*e*, which is the outer surface of the housing 10. The heat generated from the inverter 65 is dissipated through the inverter housing member 66 to the second motor housing member 15. Since the second motor housing member 15 is cooled by the coolant flowing through the cooling medium passage 13*a*, the heat generated from the inverter 65 is efficiently dissipated to the second motor housing member 15. As a result, the inverter 65 is cooled.

The centrifugal compressor 100 includes a seal member 63. The seal member 63 is located between the first insertion hole 23 and the rotary shaft 50. The seal member 63 restricts air leakage toward the interior of the motor chamber 14*c* from the first impeller chamber 36 through the first insertion hole 23 and the interior of the first bearing retainer 21. The seal member 63 is, for example, a seal ring.

The centrifugal compressor 100 includes a seal member 64. The seal member 64 is located between the second insertion hole 26 and the rotary shaft 50. The seal member 64 restricts air leakage toward the interior of the motor chamber 14*c* from the second impeller chamber 41 through the second insertion hole 26 and the interior of the second bearing retainer 25. The seal member 64 is, for example, a seal ring.

Connection Passage

As shown in FIGS. 1 and 2, the centrifugal compressor 100 includes a connection passage 70. The connection passage 70 connects the first discharge port 39 to the second suction port 40 such that air flows from the first discharge port 39 toward the second suction port 40. The connection passage 70 includes a first impeller housing member connection passage 101, a second impeller housing member connection passage 102, and a motor housing member connection passage 13*b*. Thus, in the present embodiment, the connection passage 70 is defined by the first impeller housing member connection passage 101, the second impeller housing member connection passage 102, and the motor housing member connection passage 13*b*.

The first compressor housing member 11 includes a first passage 11*a*. The first compressor housing member 11 has a first passage defining surface 11*b*. The first passage defining surface 11*b* defines the first passage 11*a*. A first end of the first passage 11*a* is connected to the first discharge port 39. A second end of the first passage 11*a* opens in the end face of the first compressor housing member 11 located toward the second plate 17 and at a portion located outward from the first discharge chamber 37 in the radial direction of the rotary shaft 50. The first passage defining surface 11*b* is a curved surface extending from an opening edge at the second end of the first passage 11*a*.

The second plate 17 has a second plate hole 17*a*. The second plate 17 includes a second plate hole defining surface 17*b*. The second plate hole defining surface 17*b* defines the second plate hole 17*a*. The second plate hole defining surface 17*b* is continuous with the first passage defining surface 11*b*. In other words, the second plate hole 17*a* is connected to the first passage 11*a*. The second plate hole 17*a* opens in the opposite end faces of the second plate 17 in the thickness direction. The second plate hole 17*a* is connected to the second end of the first passage 11*a*.

The first impeller housing member connection passage 101 is defined by the first passage 11*a* and the second plate hole 17*a*. In other words, the first impeller housing member connection passage 101 is formed in the first impeller housing member 10*b*. Thus, the first impeller housing member connection passage 101 is formed in the housing 10. A first end of the first impeller housing member connection passage 101 is connected to the first discharge port 39. Air flows through the first impeller housing member connection passage 101 from the first discharge port 39. Thus, the first impeller housing member connection passage 101 is located in the first impeller housing member 10*b* and connected to the first discharge port 39. A second end of the first impeller housing member connection passage 101 opens in the end face of the second plate 17 located toward the first plate 16 and at a portion located outward from the first discharge chamber 37 in the radial direction of the rotary shaft 50.

A boundary L1 between the first end of the first impeller housing member connection passage 101 and the first discharge port 39 is indicated by the long dashed double-short dashed line in FIG. 2. The portion of the first impeller housing member 10*b* corresponding to the boundary L1 between the first end of the first impeller housing member connection passage 101 and the first discharge port 39 corresponds to the location where a first end of a pipe that has been conventionally used to connect the first discharge port 39 to the second suction port 40 is connected. The first impeller housing member connection passage 101 of the present embodiment extends from a portion corresponding to the location where the first end of the conventional pipe is connected.

Figure 3:
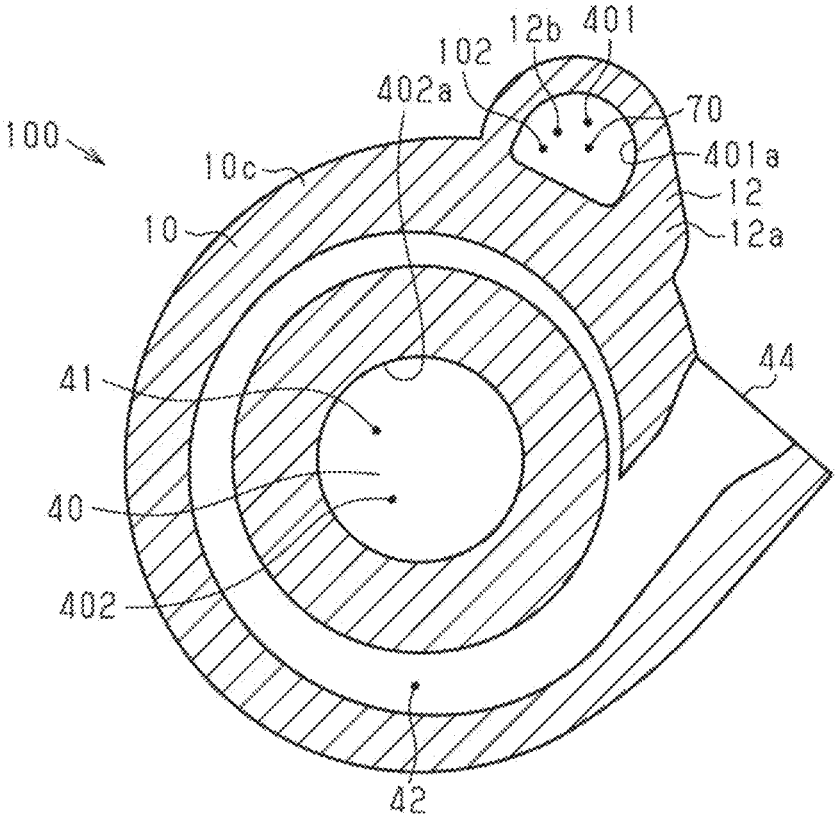
FIG. 3 is a cross-sectional view of the second impeller housing member.
Figure 4:
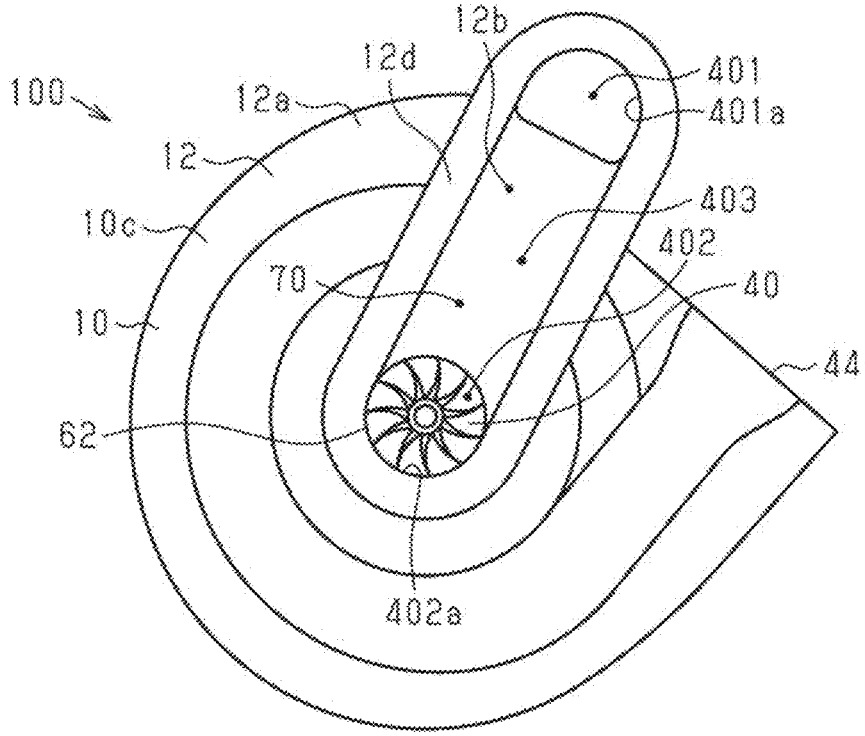
FIG. 4 is a rear view of the second impeller housing member base.

The second compressor housing member 12 includes a second passage 12*b*. As shown in FIGS. 1, 3, and 4, the second passage 12*b* includes a first axial passage 401, a second axial passage 402, and a radial passage 403. The first axial passage 401 is formed in the second impeller housing member base 12*a*. In other words, the first axial passage 401, which is a part of the second passage 12*b*, is formed in the second impeller housing member base 12*a*. The second impeller housing member base 12*a* includes a first axial passage defining surface 401*a*, which defines the first axial passage 401. The first axial passage 401 is located outward from the second suction port 40 in the radial direction of the rotary shaft 50 and extends in the axial direction of the rotary shaft 50. The first axial passage 401 extends through the second impeller housing member base 12*a* in the axial direction of the rotary shaft 50. A first end of the first axial passage 401 opens in the end face of the second impeller housing member base 12*a* located toward the third plate 18. A second end of the first axial passage 401 opens in the end face of the second impeller housing member base 12*a* on a side opposite to the third plate 18. The end face of the second impeller housing member base 12*a* on the side opposite to the third plate 18 is an axial end face 12*d*, which is an end face of the second impeller housing member base 12*a* located in the axial direction of the rotary shaft 50. Thus, the first axial passage 401 opens in the axial end face 12*d*.

The first axial passage 401 includes a third suction port 401*b* that is an opening at the first end and a third discharge port 401*c* that is an opening at the second end. In other words, the second impeller housing member 10*c* includes the third suction port 401*b* and the third discharge port 401*c*. The third suction port 401*b* and the third discharge port 401*c* open in the second impeller housing member base 12*a*.

The second axial passage 402 is formed in the second impeller housing member base 12*a*. A first end of the second axial passage 402 is connected to the second suction port 40. In other words, the second passage 12*b* is located in the second compressor housing member 12 and connected to the second suction port 40. A second end of the second axial passage 402 opens in the axial end face 12*d*. Thus, the second suction port 40 extends from the second impeller chamber 41 in the axial direction of the rotary shaft 50 and opens in the axial end face 12*d* through the second axial passage 402. The axis of the second suction port 40 coincides with the axis of the second axial passage 402. The second impeller housing member base 12*a* includes a second axial passage defining surface 402*a*, which defines the second axial passage 402.

Figure 5:
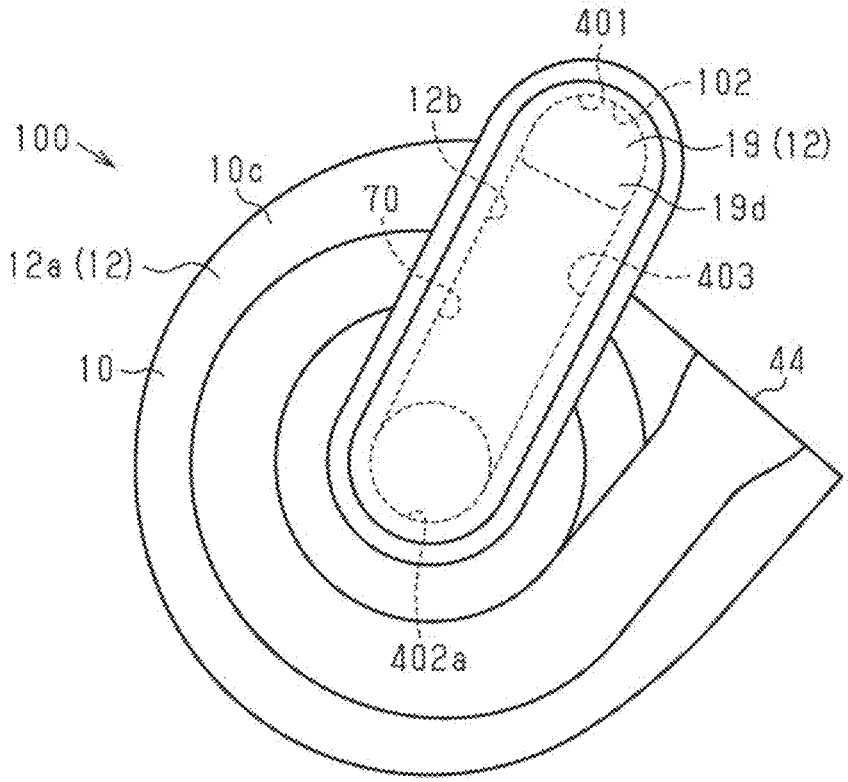
FIG. 5 is a rear view of the second impeller housing member base and the second impeller housing member cover.

Referring to FIGS. 1 and 5, the second impeller housing member cover 19 is manufactured through die casting. The second impeller housing member cover 19 is coupled to the axial end face 12*d* of the second impeller housing member base 12*a*. The second impeller housing member cover 19 seals the opening of the second suction port 40 located toward the axial end face 12*d* and the opening of the first axial passage 401 located toward the axial end face 12*d*.

As shown in FIG. 1, the second impeller housing member cover 19 includes a facing surface 19*b* that faces the axial end face 12*d* of the second impeller housing member base 12*a*. In other words, the second impeller housing member cover 19 includes the facing surface 19*b*, which faces the second impeller housing member base 12*a* in the axial direction of the rotary shaft 50. The facing surface 19*b* is flat.

The facing surface 19*b* of the second impeller housing member cover 19 includes a guide 19*d*. The guide 19*d* has the shape of a groove. Thus, the second impeller housing member 10*c* includes the second impeller housing member cover 19 with the groove-shaped guide 19*d*. With the second impeller housing member cover 19 coupled to the axial end face 12*d* of the second impeller housing member base 12*a*, the interior of the guide 19*d* connects the second end of the first axial passage 401 to the second end of the second axial passage 402. In other words, the guide 19*d* is connected to the first axial passage 401 through the third discharge port 401*c*. The section between an inner surface 19*c* of the guide 19*d* and the axial end face 12*d* of the second impeller housing member base 12*a* is the radial passage 403. Thus, the section between the second impeller housing member cover 19 and the second impeller housing member base 12*a* includes the radial passage 403, which is a part of the second impeller housing member connection passage 102, which extends in the radial direction of the rotary shaft 50, and through which air from the first axial passage 401 flows toward the second suction port 40. In this manner, the guide 19*d* defines the radial passage 403.

The inner surface 19*c* of the guide 19*d* includes a first cover connection surface 191, a second cover connection surface 192, and a bottom surface 193. The bottom surface 193 is a flat surface extending in the radial direction of the rotary shaft 50. The first cover connection surface 191 extends from an opening edge 19*e* of the guide 19*d* and is connected to the bottom surface 193. The first cover connection surface 191 extends from a portion of the opening edge 19*e* of the guide 19*d* located toward the first axial passage 401. The first cover connection surface 191 is curved such that the direction extending from the opening edge 19*e* of the guide 19*d* toward the bottom surface 193 is oriented from the axial direction of the first axial passage 401 toward a direction orthogonal to the axial direction of the first axial passage 401. The first cover connection surface 191 is curved such that the direction of the flow of air that has passed through the first axial passage 401 changes from the extending direction of the first axial passage 401 to the extending direction of the radial passage 403. The first cover connection surface 191 smoothly connects the first axial passage defining surface 401*a* to the bottom surface 193.

The second cover connection surface 192 extends from the opening edge 19*e* of the guide 19*d* and is connected to the bottom surface 193. The second cover connection surface 192 extends from a portion of the opening edge 19*e* of the guide 19*d* located toward the second suction port 40. The second cover connection surface 192 is curved such that the direction extending from the opening edge 19*e* of the guide 19*d* toward the bottom surface 193 is oriented from the axial direction of the second axial passage 402 toward a direction orthogonal to the axial direction of the second axial passage 402. The second cover connection surface 192 is curved such that the direction of the flow of air that has passed through the radial passage 403 is the direction in which the air flows into the second suction port 40. The second cover connection surface 192 smoothly connects the second axial passage defining surface 402*a* to the bottom surface 193.

The third plate 18 has a third plate hole 18*a*. The third plate 18 includes a third plate hole defining surface 18*b*. The third plate hole defining surface 18*b* defines the third plate hole 18*a*. The diameter of the third plate hole 18*a* is the same as the diameter of the first axial passage 401. The axis of the third plate hole 18*a* coincides with the axis of the first axial passage 401. The third plate hole defining surface 18*b* is continuous with the first axial passage defining surface 401*a*. The third plate hole 18*a* opens in the opposite end faces of the third plate 18 in the thickness direction. The third plate hole 18*a* is connected to the first end of the first axial passage 401 and connected to the third suction port 401*b*.

The second impeller housing member connection passage 102 is defined by the second passage 12*b* and the third plate hole 18*a*. In other words, the second impeller housing member 10*c* defines the second impeller housing member connection passage 102, which causes air to flow toward the second suction port 40.

A boundary L2 between the second impeller housing member connection passage 102 and the second suction port 40 is shown by the long dashed double-short dashed line in FIG. 1. The portion of the second impeller housing member 10*c* corresponding to the boundary L2 between the second impeller housing member connection passage 102 and the first suction port 35 corresponds to the location where a second end of the pipe, which has been conventionally used to connect the first discharge port 39 to the second suction port 40, is connected. The second impeller housing member connection passage 102 of the present embodiment extends from a portion corresponding to the location where the second end of the conventional pipe is connected.

The second motor housing member 15 has a connection hole 15*d*. The second motor housing member 15 includes a connection hole defining surface 15*b*. The connection hole defining surface 15*b* defines the connection hole 15*d*. The connection hole 15*d* extends in the axial direction of the second motor housing member 15 and opens in the opposite end faces of the second motor housing member 15 in the axial direction. The connection hole 15*d* is located outward from the motor housing member accommodation hole 15*c* in the radial direction of the rotary shaft 50. The extending direction of the connection hole 15*d* coincides with the axial direction of the rotary shaft 50. The axis of the connection hole 15*d* coincides with the axis of the third plate hole 18*a*. The diameter of the connection hole 15*d* is the same as the diameter of the third plate hole 18*a*. The connection hole defining surface 15*b* is continuous with the third plate hole defining surface 18*b*. The connection hole 15*d* is connected to the third plate hole 18*a*.

The first plate 16 has a first plate hole 16*a*. The first plate 16 includes a first plate hole defining surface 16*b*. The first plate hole defining surface 16*b* defines the first plate hole 16*a*. The diameter of the first plate hole 16*a* is equal to the diameters of the connection hole 15*d* and the second plate hole 17*a*. The axis of the first plate hole 16*a* coincides with the axes of the connection hole 15*d* and the second plate hole 17*a*. The first plate hole defining surface 16*b* is continuous with the connection hole defining surface 15*b* and the second plate hole defining surface 17*b*. The first plate hole 16*a* opens in the opposite end faces of the first plate 16 in the thickness direction. A first end of the first plate hole 16*a* is connected to one of the ends of the second plate hole 17*a* in the axial direction that is not connected to the first passage 11*a*. A second end of the first plate hole 16*a* is connected to the first end of the connection hole 15*d*.

The connection hole 15*d* and the first plate hole 16*a* form the motor housing member connection passage 13*b*. The connection hole defining surface 15*b* and the first plate hole defining surface 16*b* form the third passage defining surface 13*c*, which defines the motor housing member connection passage 13*b*. Thus, the connection passage defining housing member 13 defines the motor housing member connection passage 13*b*. The motor housing member connection passage 13*b* extends through the motor housing member 10*a* and connects the first impeller housing member connection passage 101 to the second impeller housing member connection passage 102. The motor housing member connection passage 13*b* extends through the second motor housing member 15. The first end of the third plate hole 18*a* is connected to the motor housing member connection passage 13*b*. The third suction port 401*b* faces the motor housing member connection passage 13*b*, drawing in air in the axial direction of the rotary shaft 50. The cooling medium passage 13*a* is located between the motor 20 and the motor housing member connection passage 13*b* in the radial direction of the rotary shaft 50.

Accordingly, the connection passage 70 is formed by the first impeller housing member connection passage 101, the second impeller housing member connection passage 102, and the motor housing member connection passage 13*b*. The connection passage 70 is formed by the first impeller housing member 10*b*, the second impeller housing member 10*c*, and the connection passage defining housing member 13. In other words, the connection passage 70 is formed by sequentially overlapping the first impeller housing member 10*b*, the motor housing member 10*a*, and the second impeller housing member 10*c* with each other in the axial direction of the rotary shaft 50.

The centrifugal compressor 100 includes a third seal member 83. The third seal member 83 is located between the second plate 17 and the first plate 16. The third seal member 83 is, for example, an O-ring. The third seal member 83 seals the section between the second plate 17 and the first plate 16. In the centrifugal compressor 100, the first impeller housing member 10*b* and the motor housing member 10*a* are coupled to each other, with the third seal member 83 in between. As a result, the first impeller housing member connection passage 101 is connected to the motor housing member connection passage 13*b*.

The centrifugal compressor 100 includes a fifth seal member 85 and an eighth seal member 88. The fifth seal member 85 and the eighth seal member 88 are located between the motor housing member 10*a* and the third plate 18. The fifth seal member 85 is located between the second motor housing member 15 and the third plate 18. The eighth seal member 88 is located between the first motor housing member 14 and the third plate 18. The fifth seal member 85 and the eighth seal member 88 are, for example, O-rings. The fifth seal member 85 seals the space between the second motor housing member 15 and the third plate 18. The eighth seal member 88 seals the space between the first motor housing member 14 and the third plate 18. In other words, the fifth seal member 85 and the eighth seal member 88 seal the space between the motor housing member 10*a* and the third plate 18. In the centrifugal compressor 100, the motor housing member 10*a* and the second impeller housing member 10*c* are coupled to each other, with the fifth seal member 85 and the eighth seal member 88 located in between. As a result, the second impeller housing member connection passage 102 is connected to the motor housing member connection passage 13*b*.

The centrifugal compressor 100 includes a first seal member 81, a second seal member 82, a fourth seal member 84, a sixth seal member 86, and a seventh seal member 87. The first seal member 81 seals the space between the first compressor housing member 11 and the second plate 17. The second seal member 82 seals the space between the third plate 18 and the second compressor housing member 12. The fourth seal member 84 seals the space between the second motor housing member 15 and the first plate 16. The sixth seal member 86 seals the space between the second impeller housing member base 12*a* and the second impeller housing member cover 19. The seventh seal member 87 seals the space between the first plate 16 and the first motor housing member 14. The first seal member 81, second seal member 82, fourth seal member 84, sixth seal member 86, and seventh seal member 87 are, for example, O-rings.

Operation of Present Embodiment

The air drawn into the first impeller chamber 36 through the first suction port 35 is delivered to the first diffuser passage 38 while being accelerated by rotation of the first impeller 61, and is then pressurized by passing through the first diffuser passage 38. The air that has passed through the first diffuser passage 38 is discharged to the first discharge chamber 37. The air discharged to the first discharge chamber 37 is discharged to the first discharge port 39. Accordingly, the first discharge port 39 discharges the air that has been compressed by the rotation of the first impeller 61.

The air discharged to the first discharge port 39 flows from the first discharge port 39 to the first impeller housing member connection passage 101. The air that has flowed through the first impeller housing member connection passage 101 is introduced into the motor housing member connection passage 13*b*. The air introduced into the motor housing member connection passage 13*b* is cooled by the coolant flowing through the cooling medium passage 13*a* as the air passes through the connection hole 15*d* in the motor housing member connection passage 13*b*. In other words, the motor 20 is cooled by the coolant flowing through the cooling medium passage 13*a*, and the air flowing through the connection passage 70 is also cooled.

The air that has passed through the motor housing member connection passage 13*b* is introduced into the first axial passage 401 through the third suction port 401*b*. In other words, the third suction port 401*b* faces the motor housing member connection passage 13*b*, drawing in air in the axial direction of the rotary shaft 50. The air that passed through the first axial passage 401 is introduced into the radial passage 403 through the third discharge port 401*c*. In other words, the third discharge port 401*c* opens so as to discharge, toward the guide 19*d*, the air that has been drawn in from the third suction port 401*b*.

The air introduced into the radial passage 403 flows smoothly along the first cover connection surface 191. In other words, the guide 19*d* guides, in the radial direction of the rotary shaft 50, the air that has been drawn in from the third suction port 401*b* in the axial direction of the rotary shaft 50 such that the air approaches the second suction port 40. Specifically, when air flows from the first axial passage 401 into the radial passage 403, the air flows along the first cover connection surface 191, thereby changing the air flow direction from the axial direction of the first axial passage 401 to the extending direction of the radial passage 403. Accordingly, the first cover connection surface 191 changes the air flow direction from along the first axial passage defining surface 401*a* to along the bottom surface 193. The second impeller housing member cover 19 guides the air flowing from the first axial passage 401 to the radial passage 403 with the first cover connection surface 191. This prevents sudden changes in the air flow direction. Thus, the second impeller housing member cover 19 prevents vortex formation when the air flow direction changes from the axial direction of the first axial passage 401 to the extending direction of the radial passage 403. In this manner, the air flowing from the first axial passage 401 into the radial passage 403 is prevented from forming vortices.

The air that has been introduced into the radial passage 403 passes through the radial passage 403 and is then introduced into the second axial passage 402. The air flowing through the radial passage 403 moves smoothly along the second cover connection surface 192. In other words, the air flowing in the radial direction of the rotary shaft 50 is further guided by the guide 19*d* in the axial direction of the rotary shaft 50 toward the second suction port 40. Specifically, when air flows from the radial passage 403 into the second axial passage 402, the air flows along the second cover connection surface 192. As a result, the air flow direction changes from the extending direction of the radial passage 403 to the axial direction of the second axial passage 402. Accordingly, the second cover connection surface 192 changes the air flow direction from along the bottom surface 193 to along the second axial passage 402. The second impeller housing member cover 19 guides the air flowing from the radial passage 403 into the second axial passage 402 with the second cover connection surface 192. This prevents sudden changes in the air flow direction. Thus, the second impeller housing member cover 19 prevents vortex formation when the air flow direction changes from the extending direction of the radial passage 403 to the axial direction of the second axial passage 402. In this manner, the air flowing from the radial passage 403 toward the second suction port 40 is prevented from forming vortices.

As described above, the third discharge port 401*c* is connected to the second suction port 40 by the guide 19*d*. In other words, the groove-shaped guide 19*d*, which opens such that air flows from the third discharge port 401*c* toward the second suction port 40, is formed on the second impeller housing member cover 19.

The air that has passed through the second axial passage 402 is drawn into the second impeller chamber 41 through the second suction port 40. The air drawn into the second impeller chamber 41 is delivered to the second diffuser passage 43 while being accelerated by rotation of the second impeller 62, and is then pressurized by passing through the second diffuser passage 43. The air that has passed through the second diffuser passage 43 is discharged to the second discharge chamber 42. The air discharged to the second discharge chamber 42 is discharged to the second discharge port 44. Accordingly, the second discharge port 44 discharges the air that has been compressed by the rotation of the second impeller 62. The air discharged to the second discharge port 44 is supplied to the fuel cell stack 46 through the supply pipe 45. The oxygen contained in the air supplied to the fuel cell stack 46 contributes to power generation in the fuel cell stack 46.

Advantages of Present Embodiment

The advantages of the present embodiment will now be described.

(1) The connection passage 70 is formed by the first impeller housing member 10*b*, the motor housing member 10*a*, and the second impeller housing member 10*c*, all of which are included in the housing 10. In other words, the connection passage 70 is formed inside the housing 10. For example, this prevents the formation of a gap between the housing 10 and a pipe, which is separate from the housing 10, like in a configuration in which the first discharge port 39 and the second suction port 40 are connected to each other by attaching the pipe to the housing 10. Thus, the centrifugal compressor 100 is prevented from being unnecessarily enlarged by an amount corresponding to the gap between the housing 10 and the pipe. Further, the connection passage 70 can be formed only by sequentially overlapping and coupling the first impeller housing member 10*b*, the motor housing member 10*a*, and the second impeller housing member 10*c* with each other in the axial direction of the rotary shaft 50. This eliminates, for example, the need to provide a structure in the pipe that can absorb the dimensional tolerances that occur between the housing 10 and the pipe when attaching the pipe to the housing 10. Thus, the production efficiency of the centrifugal compressor 100 is improved. This improves the production efficiency of the centrifugal compressor 100 while also limiting its increase in size.

(2) The cooling medium passage 13*a* is located between the motor 20 and the motor housing member connection passage 13*b* in the radial direction of the rotary shaft 50. This allows the coolant flowing through the cooling medium passage 13*a* to cool not only the motor 20 but also the air flowing through the motor housing member connection passage 13*b*. Thus, the air cooled by the coolant can be drawn into the second impeller chamber 41 through the motor housing member connection passage 13*b*, the second impeller housing member connection passage 102, and the second suction port 40. The air cooled by the coolant has a lower density than air that has not been cooled. In other words, when air is cooled before being drawn into the second impeller chamber 41, the mass of the air being drawn into the second impeller chamber 41 increases. Thus, the second impeller 62 compresses a larger mass of air compared to when compressing air that has not been cooled. This improves the efficiency of air compression accompanying the rotation of the second impeller 62.

(3) For example, when constructing the cooling medium passage 13*a* with a single housing member, it is necessary to manufacture such a housing member using a casting method that uses a core. The manufacturing method that uses a core incurs higher production costs than a manufacturing method that does not use a core. To solve this problem, the cooling medium passage 13*a* is defined such that coolant flows between the first motor housing member 14 and the second motor housing member 15. Each of the first motor housing member 14 and the second motor housing member 15, which define the cooling medium passage 13*a*, does not need to be manufactured using the casting method that uses a core. In other words, in the motor housing member 10*a*, which includes the first motor housing member 14 and the second motor housing member 15, the cooling medium passage 13*a* can be formed using the manufacturing method that does not use a core. As a result, the above configuration enables the formation of the cooling medium passage 13*a* in the motor housing member 10*a* while reducing manufacturing costs.

(4) The third suction port 401*b* draws, in the axial direction of the rotary shaft 50, air that has flowed through the motor housing member connection passage 13*b*. The guide 19*d* guides, in the radial direction of the rotary shaft 50, the air that has been drawn in from the third suction port 401*b* in the axial direction of the rotary shaft 50 such that the air approaches the second suction port 40. Further, the air flowing in the radial direction of the rotary shaft 50 is guided by the guide 19*d* in the axial direction of the rotary shaft 50 toward the second suction port 40. Thus, the guiding of air by the guide 19*d* prevents the formation of vortices when the air flow direction changes. As a result, the second impeller housing member 10*c* having the guide 19*d* reduces the pressure loss of air flowing from the third suction port 401*b* toward the second suction port 40. Accordingly, the efficiency of air compression accompanying the rotation of the second impeller 62 is improved.

(5) For example, there may be a case in which a single housing member forms a passage through which air flows from the third suction port 401*b* to the second suction port 40. The second suction port 40 extends in the axial direction of the rotary shaft 50 from the second impeller chamber 41. At a position outward from the second suction port 40 in the radial direction of the rotary shaft 50, the passage from the third suction port 401*b* to the third discharge port 401*c* extends in the axial direction of the rotary shaft 50 from the motor housing member connection passage 13*b*. In other words, the passage through which air flows from the third discharge port 401*c* to the second suction port 40 extends in the radial direction of the rotary shaft 50. In order to manufacture such a housing member including the passage from the third suction port 401*b* to the third discharge port 401*c* and the passage from the third discharge port 401*c* to the second suction port 40, a casting method that uses a core may be employed. This leads to higher manufacturing costs.

To solve such a problem, the second impeller housing member 10*c* includes the second impeller housing member base 12*a* and the second impeller housing member cover 19. The second impeller housing member base 12*a* includes the second suction port 40 and the passage that connects the third suction port 401*b* to the third discharge port 401*c*. The second impeller housing member cover 19 is connected to one of the surfaces of the second impeller housing member base 12*a* where the third discharge port 401*c* opens. Thus, the second impeller housing member cover 19 seals the opening at one end of the second suction port 40 and the opening defined by the third discharge port 401*c*. Additionally, the passage between the second impeller housing member cover 19 and the second impeller housing member base 12*a*, which is defined by the guide 19*d* and the second impeller housing member base 12*a*, is formed to connect the third discharge port 401*c* and the second suction port 40 to each other. This eliminates the need for manufacturing with a casting method that uses a core, like in the case in which a single housing member forms a passage through which air flows from the third suction port 401*b* to the second suction port 40. Accordingly, increases in the manufacturing costs are avoided.

(6) The inverter 65 is provided on the housing outer surface 10*e*. That is, the coolant flowing through the cooling medium passage 13*a* cools the motor 20, the air flowing through the connection passage 70, and the inverter 65. In other words, the configuration of forming the connection passage 70 inside the housing 10 and placing the inverter 65 on the outer surface of the housing 10 reduces the size of the centrifugal compressor 100. Further, a single cooling medium passage 13*a* can simultaneously cool the motor 20, the air flowing through the connection passage 70, and the inverter 65. This improves the efficiency of compression by the second impeller 62 and the efficiency of dissipating the heat generated during operation of the centrifugal compressor 100, while limiting an increase in the size of the centrifugal compressor 100.

(7) Multiple annular fins 14*d* extend along the outer circumferential surface of the circumferential wall 14*b* on the outer circumferential surface of the first motor housing member 14. Thus, coolant flowing through the cooling medium passage 13*a* flows along each fin 14*d* in the circumferential direction of the first motor housing member 14 and the second motor housing member 15. This allows for efficient heat exchange with the first motor housing member 14, second motor housing member 15, and inverter housing member 66. In other words, coolant flows along each fin 14*d* so as to efficiently cool the motor 20, the air flowing through the cooling medium passage 13*a*, and the inverter 65. Here, for example, the configuration in which the annular fins 14*d* extending along the outer circumferential surface of the circumferential wall 14*b* of the first motor housing member 14 are protruded into the cooling medium passage 13*a* and the connection passage 70 is formed in the housing 10, may be achieved by a single housing member. Manufacturing such a housing member requires the use of a casting method that uses a core, leading to higher manufacturing costs. In the present embodiment, the first motor housing member 14 is separate from the second motor housing member 15. In such a configuration, each of the first motor housing member 14 and the second motor housing member 15 does not need to be manufactured using the casting method that uses a core. This allows for, while reducing manufacturing costs, the configuration in which the annular fins 14*d* extending along the outer circumferential surface of the circumferential wall 14*b* of the first motor housing member 14 are protruded into the cooling medium passage 13*a* and the connection passage 70 is formed in the housing 10.

Modifications

The above embodiment may be modified as follows. The above embodiment and the following modifications can be combined as long as the combined modifications remain technically consistent with each other.

The facing surface 19*b* of the impeller housing member cover 19 does not have to include the guide 19*d*. In this case, for example, a recess extending in the radial direction of the rotary shaft 50 is formed on the axial end face 12*d* of the second impeller housing member base 12*a*, and this recess may function as the guide 19*d*. That is, the second impeller housing member base 12*a* may include the guide 19*d*.

The second impeller housing member 10*c* does not have to include the second impeller housing member cover 19. In this case, the second impeller housing member 10*c* includes the second impeller housing member base 12*a* and the third plate 18. In this case, the first axial passage 401 and the second suction port 40 are connected to each other through the second impeller housing member base 12*a* without opening in the axial end face 12*d*. That is, in this case, the second impeller housing member 10*c* does not need to include the third discharge port 401*c*.

The second impeller housing member base 12*a* does not have to include the second axial passage 402. In this case, the second suction port 40 is directly connected to the radial passage 403.

The motor housing member 10*a* does not have to include the first motor housing member 14 and the second motor housing member 15. In other words, the motor housing member 10*a* may include a single housing component. In this case, the cooling medium passage 13*a* is formed inside the housing 10.

The cooling medium passage 13*a* does not have to be provided between the motor 20 and the motor housing member connection passage 13*b* in the radial direction of the rotary shaft 50.

The centrifugal compressor 100 does not have to include the cooling medium passage 13*a*.

The centrifugal compressor 100 may have a configuration in which a single thin fin extends helically along the outer circumferential surface of the circumferential wall 14*b* of the first motor housing member 14.

Fins do not have to be provided on the outer circumferential surface of the circumferential wall 14*b* of the first motor housing member 14. In this case, the coolant flowing through the cooling medium passage 13*a* may flow along the outer circumferential surface of the circumferential wall 14*b* of the first motor housing member 14 in the axial direction of the circumferential wall 14*b*.

The cooling medium flowing through the cooling medium passage 13*a* may be a substance other than coolant. For example, the cooling medium may be refrigerant or air.

The inverter 65 does not have to be provided on the housing outer surface 10*e*.

The fluid that is to be compressed by the centrifugal compressor 100 is not limited to air. Thus, the centrifugal compressor 100 may be employed in any suitable application to compress any type of fluid. For example, the centrifugal compressor 100 may be employed in an air conditioner to compress refrigerant, which is fluid. Further, the centrifugal compressor 100 may be mounted on any structure other than a vehicle.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A centrifugal compressor, comprising:

a rotary shaft;

a motor that rotates the rotary shaft;

a first impeller that rotates integrally with the rotary shaft to compress a fluid;

a second impeller located on an opposite side of the rotary shaft from the first impeller, wherein the motor is arranged between the first impeller and the second impeller, and the second impeller rotates integrally with the rotary shaft;

a housing including:

a first impeller housing member that defines a first impeller chamber accommodating the first impeller, the first impeller housing member including a first suction port that draws the fluid into the first impeller chamber and a first discharge port that discharges the fluid compressed by rotation of the first impeller;

a motor housing member that defines a motor chamber accommodating the motor; and a second impeller housing member that defines a second impeller chamber accommodating the second impeller, the second impeller housing member including a second suction port that draws the fluid into the second impeller chamber and a second discharge port that discharges the fluid compressed by rotation of the second impeller; and a connection passage that connects the first discharge port to the second suction port such that the fluid flows from the first discharge port toward the second suction port, wherein the connection passage includes:

a first impeller housing member connection passage located in the first impeller housing member and connected to the first discharge port;

a second impeller housing member connection passage located in the second impeller housing member and connected to the second suction port; and a motor housing member connection passage extending through the motor housing member and connecting the first impeller housing member connection passage to the second impeller housing member connection passage, and the connection passage is formed by sequentially overlapping the first impeller housing member, the motor housing member, and the second impeller housing member with each other in an axial direction of the rotary shaft.

2. The centrifugal compressor according to claim 1, wherein the motor housing member includes a cooling medium passage through which a cooling medium flows to cool the motor, and the cooling medium passage is located between the motor and the motor housing member connection passage in a radial direction of the rotary shaft.

3. The centrifugal compressor according to claim 2, wherein the motor includes:

a cylindrical stator; and a rotor provided on the rotary shaft, the rotor being configured to rotate integrally with the rotary shaft, the motor housing member includes:

a first motor housing member having an inner circumferential surface to which the stator is fixed; and a second motor housing member through which the motor housing member connection passage extends, and the cooling medium passage is defined such that the cooling medium flows between the first motor housing member and the second motor housing member.

4. The centrifugal compressor according to claim 1, wherein the second impeller housing member includes:

a third suction port that faces the motor housing member connection passage to draw in the fluid in the axial direction; and a guide that guides, in a radial direction of the rotary shaft, the fluid drawn in from the third suction port in the axial direction such that the fluid approaches the second suction port, and further guides, toward the second suction port in the axial direction, the fluid flowing in the radial direction.

5. The centrifugal compressor according to claim 4, wherein the second impeller housing member includes:

a second impeller housing member base in which the third suction port, the second suction port, and the second discharge port open and in which a third discharge port opens such that the fluid drawn in from the third suction port is discharged toward the guide; and a second impeller housing member cover that connects the third discharge port to the second suction port, the second impeller housing member cover including the guide opening such that the fluid flows from the third discharge port toward the second suction port, and the guide having a groove shape.

* * * * *